US012680779B2

(12) United States Patent
Steele et al.

(10) Patent No.: US 12,680,779 B2
(45) Date of Patent: Jul. 14, 2026

(54) ARCHERY RELEASE WITH INTERCHANGEABLE FINGER BEDS

(71) Applicant: Veritas 2, LLC, Madison Heights, VA (US)

(72) Inventors: Brent Steele, Lynchburg, VA (US); Tristan Mason, Madison Heights, VA (US); Nathanial R. Adams, Madison Heights, VA (US); Benjamin G. Summers, Madison Heights, VA (US); Gregory E. Summers, Amherst, VA (US)

(73) Assignee: Veritas 2, LLC, Madison Heights, VA (US)

( * ) Notice: Subject to any disclaimer, the term of this patent is extended or adjusted under 35 U.S.C. 154(b) by 169 days.

(21) Appl. No.: 18/787,679

(22) Filed: Jul. 29, 2024

(65) Prior Publication Data

US 2026/0029211 A1 Jan. 29, 2026

(51) Int. Cl.
*F41B 5/14* (2006.01)

(52) U.S. Cl.
CPC ..... *F41B 5/1469* (2013.01)

(58) Field of Classification Search
CPC ..... F41B 5/14; F41B 5/1469; F41B 5/1473
See application file for complete search history.

(56) References Cited

U.S. PATENT DOCUMENTS

| | | | | | |
|---|---|---|---|---|---|
| 3,768,456 | A * | 10/1973 | Hansen | F41B 5/1469 | 124/35.2 |
| 5,615,663 | A * | 4/1997 | Simonds | F41B 5/14 | 124/88 |
| 5,701,880 | A * | 12/1997 | Simonds | F41B 5/0031 | 124/88 |
| 9,255,762 | B2 * | 2/2016 | Kelly | F41B 5/1469 | |
| 10,648,760 | B2 * | 5/2020 | Gold | F41B 5/1403 | |
| 10,801,803 | B1 * | 10/2020 | Rentz | F41B 5/1469 | |
| 10,830,554 | B1 * | 11/2020 | Jones | F41B 5/1469 | |
| 11,428,500 | B2 * | 8/2022 | Langley | F41B 5/1469 | |
| 11,940,242 | B1 * | 3/2024 | Rentz | F41B 5/1469 | |
| 12,540,790 | B2 * | 2/2026 | Steele | F41B 5/1469 | |
| 12,546,558 | B2 * | 2/2026 | Steele | F41B 5/1473 | |
| 2008/0149084 | A1 * | 6/2008 | Whalen | F41B 5/1469 | 124/35.2 |
| 2015/0090241 | A1 * | 4/2015 | Kelly | F41B 5/1469 | 124/35.2 |
| 2016/0282079 | A1 * | 9/2016 | Rentz | F41B 5/1469 | |
| 2025/0172365 | A1 * | 5/2025 | Steele | F41B 5/1469 | |
| 2025/0231002 | A1 * | 7/2025 | Steele | F41B 5/1469 | |
| 2025/0244101 | A1 * | 7/2025 | Steele | F41B 5/1473 | |

* cited by examiner

*Primary Examiner* — Joshua E Freeman
(74) *Attorney, Agent, or Firm* — LEADING-EDGE LAW GROUP, PLC

(57) ABSTRACT

A handheld archery release includes a handle and at least one interchangeable finger bed removably connected with the handle. Finger beds of different angular orientations may be interchanged by the archer to provide an improved ergonomic fit of the release and improve the archer's accuracy when firing a shot.

16 Claims, 9 Drawing Sheets

ARCHERY RELEASE WITH INTERCHANGEABLE FINGER BEDS

BACKGROUND OF THE INVENTION

The present invention relates to an archery release, and more particularly to an archery release having interchangeable finger beds for an optimal fit of the release to the archer.

Release devices are used in archery to assist the archer in pulling a bowstring to a fully drawn position and then releasing the bowstring to fire an arrow. Some release devices use grippers for engaging a bowstring or a nock mounted on the bowstring. Other release devices use a rope looped around the bowstring. Handheld releases are generally of two types, using either a trigger or back tension to fire the shot.

BRIEF DESCRIPTION OF THE PRIOR ART

Virtually all handheld archery releases include a handle which is configured for gripping by the archer. Usually, the handle is gripped by the index and middle fingers of the archer, with the fingers being supported by contoured finger beds in an upper surface of the handle. However, the side portions of the handle are generally flat. The flat side walls inhibit repeatable finger bed placement by the archer which limits accuracy of a shot. The present invention was developed in order to overcome the drawbacks of existing handheld releases by providing interchangeable finger beds of different configurations which may be selected by the archer to provide improved and repeatable gripping of the release while reducing torque in comparison with flat handle designs.

SUMMARY OF THE INVENTION

Accordingly, it is a primary object of the invention to provide a handheld archery release including a handle having a longitudinal axis and front, rear, top and bottom portions with side surfaces extending therebetween. The side portions each contain at least one recess. The release further includes a finger bed configured to fit within each of the side recesses. The finger bed has an interior surface adjacent to the handle and a contoured outer surface arranged at an angle relative to the inner side surface to support a finger of the archer. A connection assembly is provided to removably connect the finger bed with the handle. This allows an archer to interchange finger beds having different angles between the inner and outer surfaces to provide a desired support position for a finger of the archer for operation of the release. Preferably, the connection assembly is a snap fit connection.

According to a first embodiment, the front and rear walls of the handle which define each recess contain an opening and the front and rear surfaces of the finger bed each include a projection configured to fit within a respective opening in the recess defining front and rear walls. When inserted into the recess, the finger bed may pivot about the projections. To retain the finger bed in a fixed position within the recess, the bottom wall of the finger bed contains an opening configured to receive a spring plunger, the spring-biased ball of which engages a detent in the bottom portion of the handle. To release a finger bed from the handle, the spring plunger is pried away from the handle bottom portion to overcome the retention feature and the front and rear surfaces of the finger bed are pinched together to remove the projections from the corresponding openings in the handle. The archer may then insert a similarly configured finger bed with a different angle between the inner and outer surfaces of the bed into the respective handle recess for an optimum fit.

A second recess may be provided in each side portion of the handle. The second recess is spaced from the first recess and also is configured to receive a finger bed. Thus, four recesses and four interchangeable finger beds are provided, the forward recesses and finger beds being configured to support the index finger of the archer and the rearward recesses and finger beds being configured to support the middle finger of the archer. The respective forward and rearward recesses and finger beds may be sized differently to support the different figures.

According to a second embodiment of the invention, the finger bed has a U-shaped configuration with a pair of generally parallel legs being spaced by a channel which is configured to bridge the top portion the handle when the finger bed legs are arranged in aligned recesses on opposite sides of the handle.

The finger bed legs include at least one projection extending from an end surface of each leg, and the bottom wall defining each recess contains an opening configured to receive a leg projection, preferably in a snap-fit connection. By slightly depressing the legs, the projections may be disengaged from the corresponding handle opening to remove the finger bed and replace it with a similarly configured finger bed with a different angle between the inner and outer leg surfaces as desired by the archer for an optimum fit.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
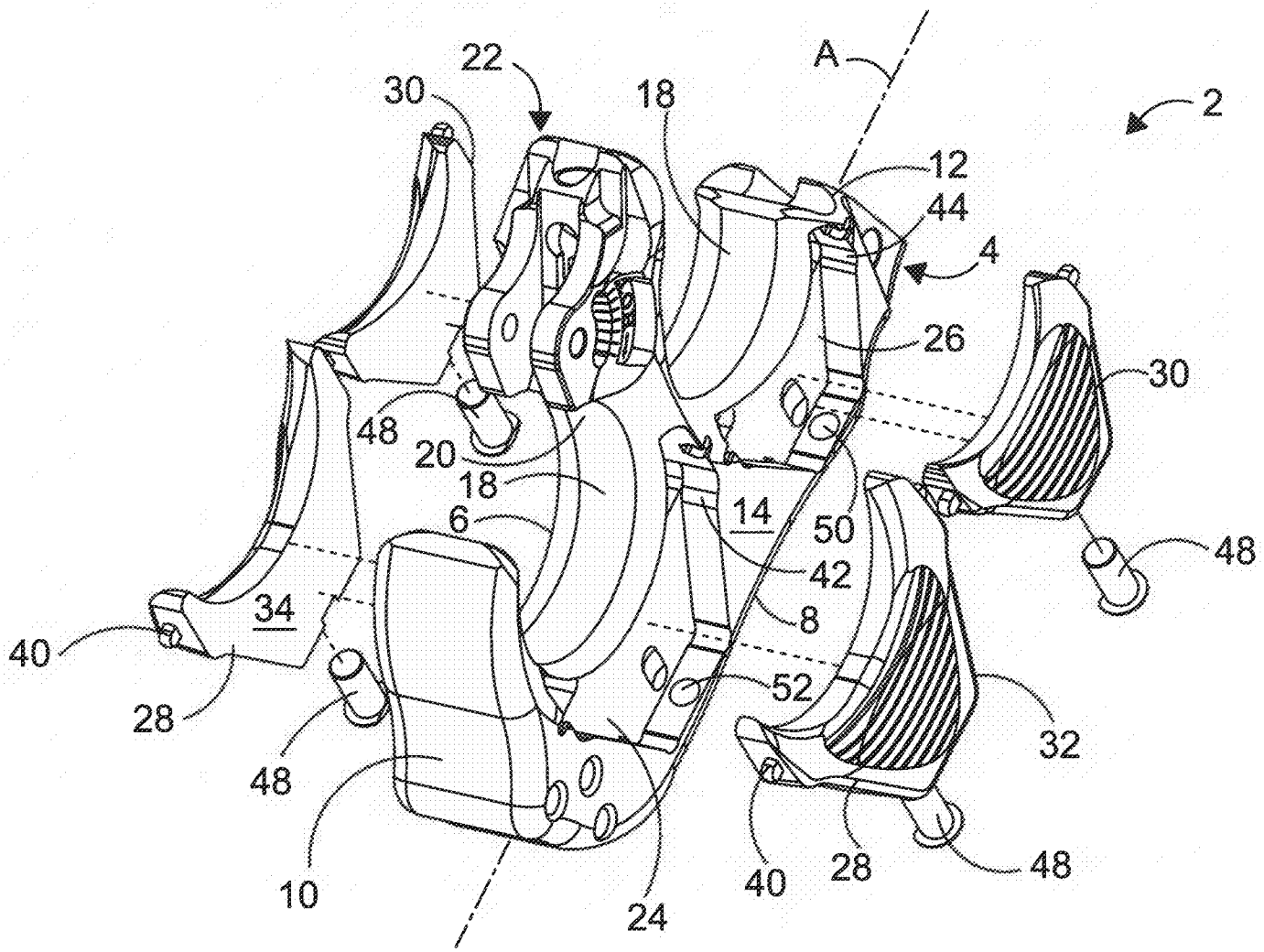
FIG. 1 is an exploded front perspective view of a handheld archery release including interchangeable finger beds according to a first embodiment of the invention.
Figure 2:
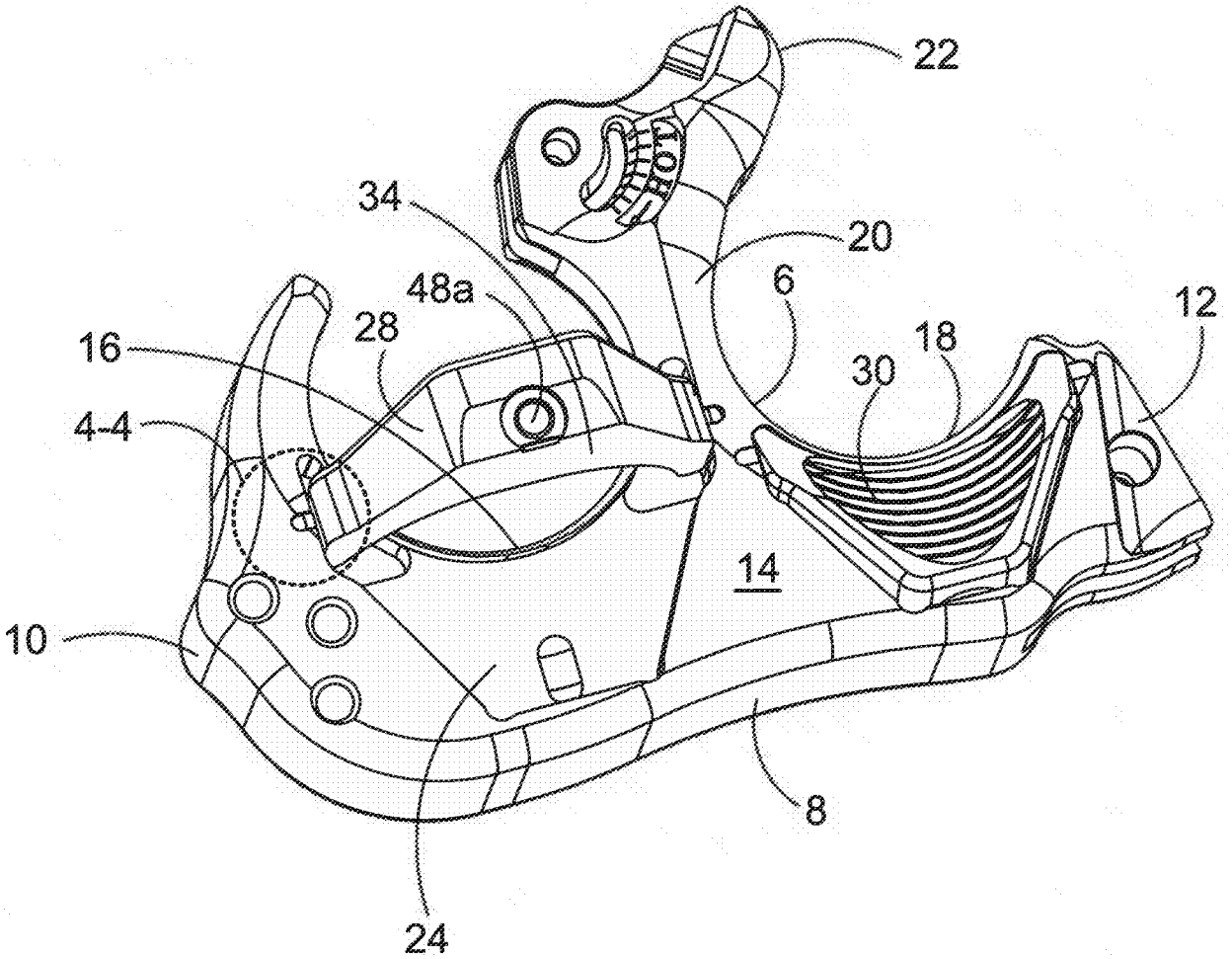
FIG. 2 is a front perspective view of the archery release with fully and partially connected finger beds, respectively.

A handheld archery release according to the invention is shown in FIGS. 1 and 2. It will be appreciated by those of ordinary skill in the art that the release may be of the thumb trigger or back tension type.

The release 2 includes a handle 4 having a longitudinal axis A and includes top 6, bottom 8, front 10, and rear 12 portions and side surfaces 14 extending between these portions. At least one concave surface is provided in the top portion and serves as support for a finger of an archer. Preferably, two longitudinally spaced concave recesses are provided. A first concave surface 16 is configured to receive the index finger of the archer and a second concave surface 18 is configured to receive the middle finger.

Between the first 16 and second 18 concave surfaces, the handle includes a contoured projection 20 on which a head assembly 22 is arranged. The head assembly includes a head and a bail (not shown) rotatably connected with the head as is known in the art. The bail is configured to receive a bow loop or a bowstring. A thumb trigger may be connected with the handle or back tension is used to activate a sear (not shown) arranged in the handle which in turn operates the head assembly to release the bow loop or bowstring to fire a shot.

The side surfaces 14 of the handle contain at least one recess 24. According to a preferred embodiment, a second recess 26 is provided in each side surface and spaced from the first recess. The first recess is arranged below the first contour 16 for the index finger of the archer and the second recess is arranged below the second contour 18 for the middle finger of the archer. Although the recesses are configured similarly, they are preferably sized differently to accommodate the differences between the archer's index and middle fingers.

A finger bed is configured to fit within each recess and a connection assembly is provided to removably connect each finger bed with a respective recess. Accordingly, a first finger bed 28 is provided for the first recess 24 to support the index finger and a second finger bed 30 is provided for the second recess 26 to support the middle finger. The first finger bed is shown more particularly in FIGS. 3 and 6-8 and the second finger bed 30 is shown more particularly in FIGS. 9-11. The finger beds will be described generically with reference to FIGS. 1-3.

Figure 3:
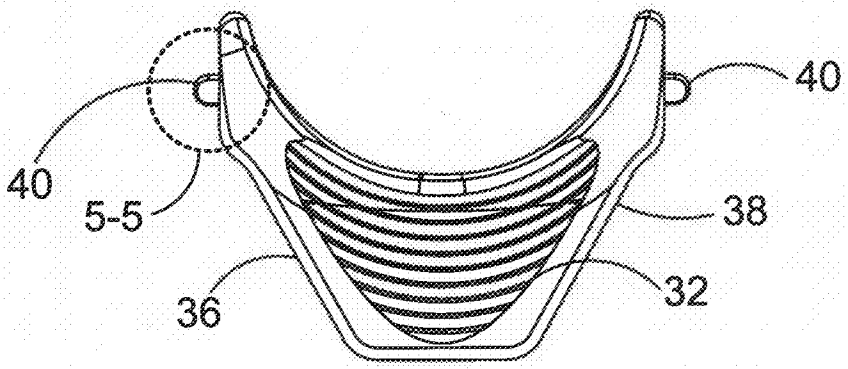
FIG. 3 is a front plan view of an interchangeable finger bed for the archery release of FIGS. 1 and 2.
Figure 4:
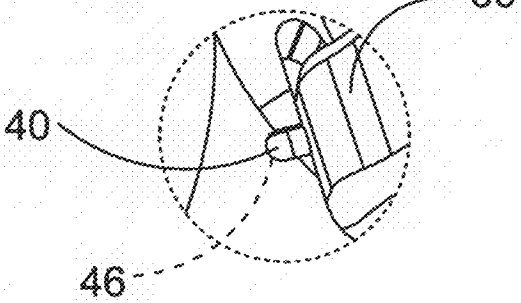
FIG. 4 is a detailed view of a portion of the release taken along line 4-4 of FIG. 2.

Each finger bed includes an inner surface 32 which is adjacent to handle when the finger bed is connected within a respective recess and an outer surface 34 which is arranged at an angle relative to the inner surface. The outer surface is preferably contoured as shown in FIG. 3 and tapered from the top of the bed to the bottom. The front 36 and rear 38 surfaces of the finger bed include bosses or projections 40.

Figure 5:
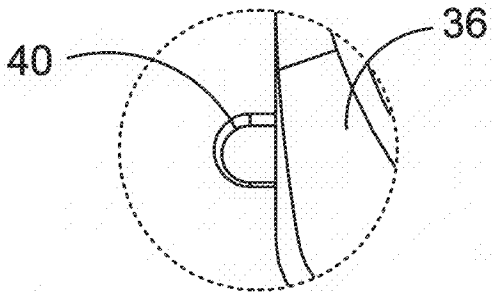
FIG. 5 is a detailed view of a portion the finger bed taken along line 5-5 of FIG. 3.

Each recess in the handle is defined by front, rear, top and bottom walls. The front and rear walls contain openings which are configured to receive the bosses or projections 40 of each finger bed. Accordingly, if the projections have a rounded configuration, the openings preferably have a radius which matches the radius of the projections for a snap-fit connection. The opening 42 in the first recess 24 rear wall and the opening 44 in the second recess rear wall are shown in FIG. 1. FIG. 5 shows in detail the projection 40 of a finger bed and FIG. 6 shows in detail the projection 40 arranged in an opening 46 in the front wall defining the first handle recess 24.

While the handle is preferably formed of a rigid material such as metal, the finger beds are preferably formed of a synthetic plastic which affords a limited degree of flexure to enable the finger bed projections to be snap-fit into the respective handle grooves. With the projections inserted into the respective grooves, the finger beds are pivotal about the projections relative to the handle. FIG. 2 shows the first finger bed 28 pivoted away from the handle 4 and the second finger bed 30 in the corresponding recess of the handle. In order to retain or fix a finger bed within a respective handle recess, a spring plunger 48 is inserted into an opening 50 in the bottom of each finger bed. As the finger bed pivots into the corresponding handle recess, a spring biased ball 48*a* of the plunger is initially depressed as the bottom of the finger bed engages a side edge at the bottom of the handle and then extends into s hemispherical detent 52 in the bottom wall of each recess for form a snap or click fit connection of the bottom of the finger bed with the bottom of the corresponding handle recess. In order to remove a finger bed, the bottom portion of the finger bed is pried away from the recess, such as with a small screwdriver, to disengage the spring plunger from the handle and the front and rear portions of the finger bed are compressed to remove the projections from the corresponding grooves. This enables the archer to replace a finger bed with another bed with a different angle between the inner and outer surfaces.

Figure 6:
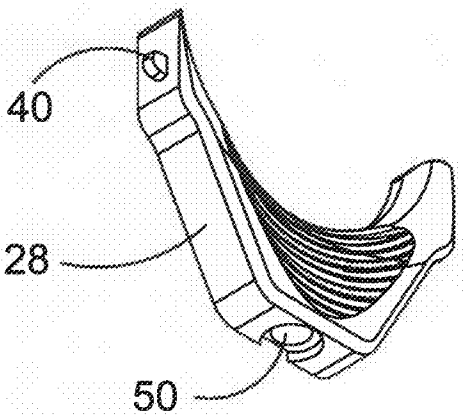
FIGS. 6 and 7 are perspective and end views, respectively, of a zero degree index finger bed for the archery release of FIG. 1.
Figure 7:
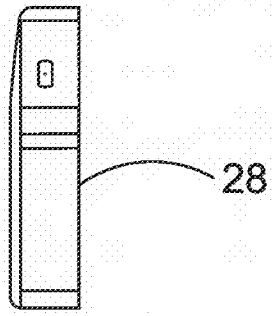
Figure 8:
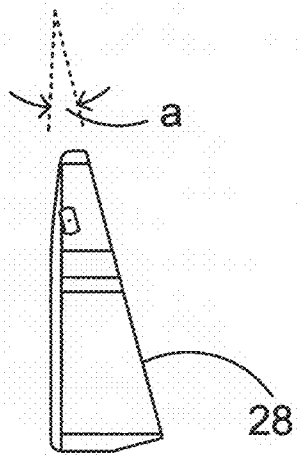
FIG. 8 is an end view of a fifteen degree index finger bed for the archery release of FIG. 1.
Figure 9:
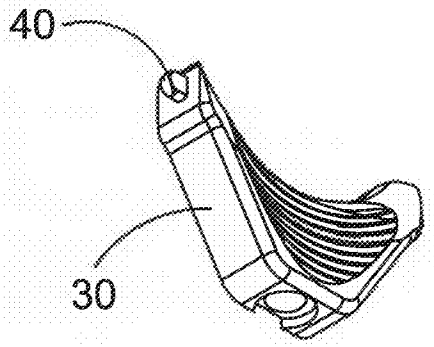
FIGS. 9 and 10 are perspective and end views, respectively of a zero degree middle finger bed for the archery release of FIG. 1.
Figure 10:
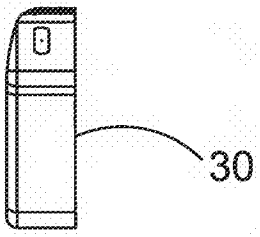
Figure 11:
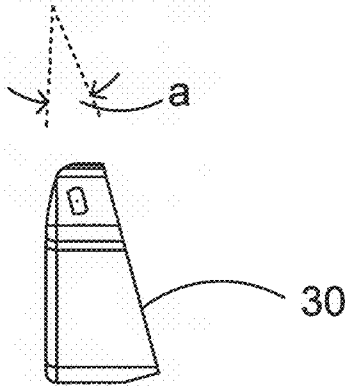
FIG. 11 is an end view of a fifteen degree middle finger bed for the archery release of FIG. 1.
Figure 12B:
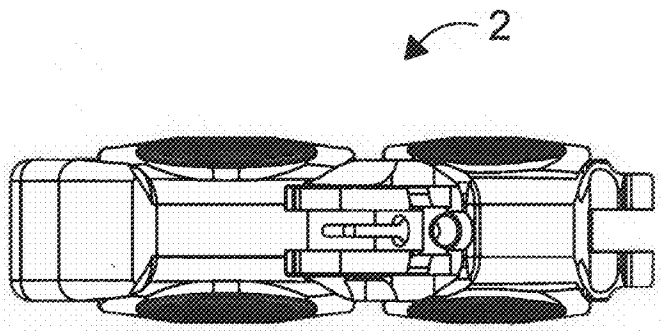
FIGS. 12*a*, 12*b*, 12*c*, and 12*d* are top views of the archery release of FIG. 1 with zero, five, ten and fifteen degree index and middle finger beds, respectively.
Figure 12D:
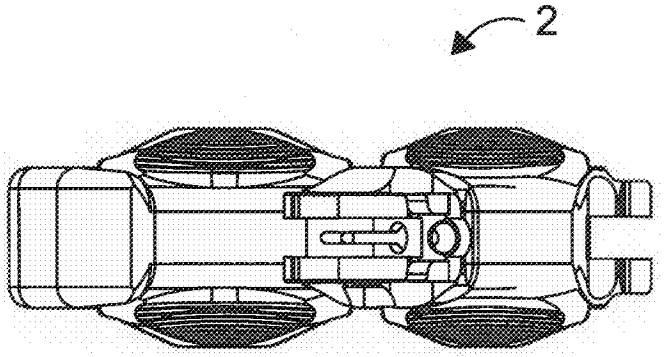
Figure 12A:
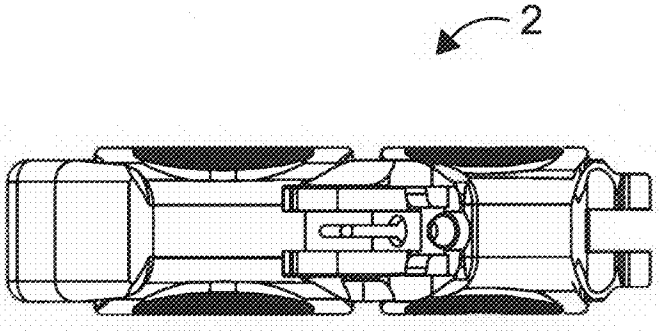
Figure 12C:
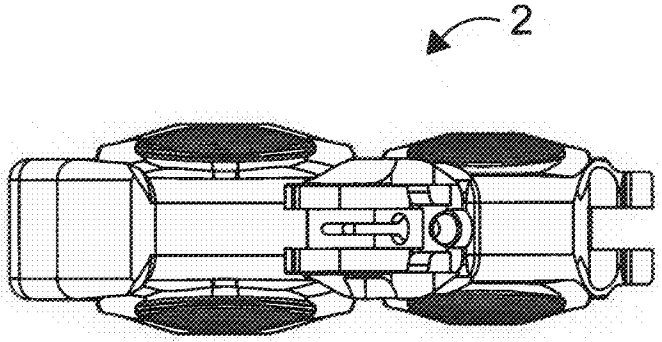
Figure 14:
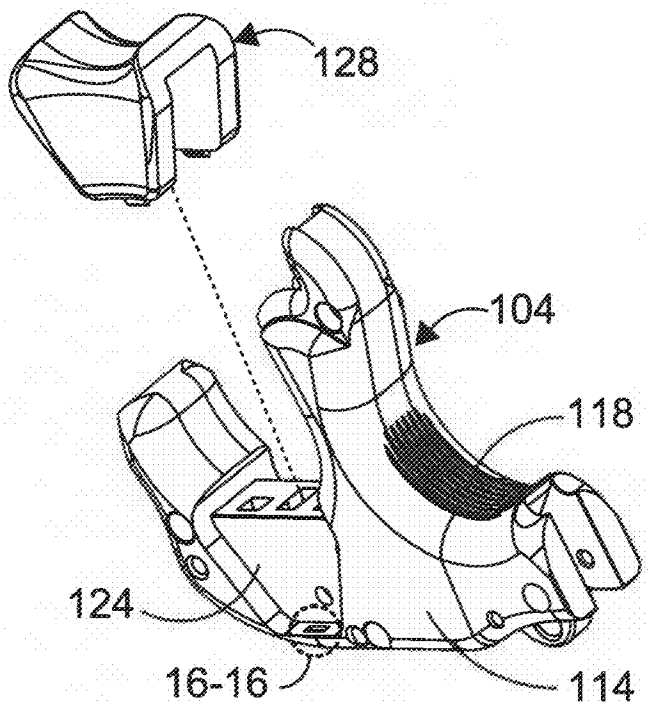
FIGS. 13 and 14 are exploded front and rear perspective views of a handheld archery release with an interchangeable finger bed according to a second embodiment of the invention.
Figure 16:
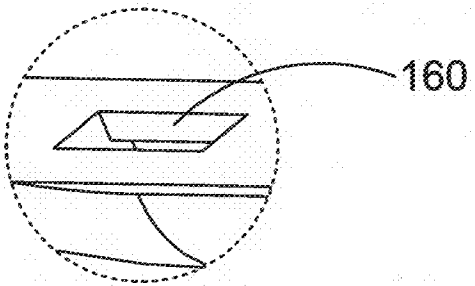
FIG. 16 is a detailed view of a portion the archery release handle taken along line 16-16 of FIG. 14.
Figure 13:
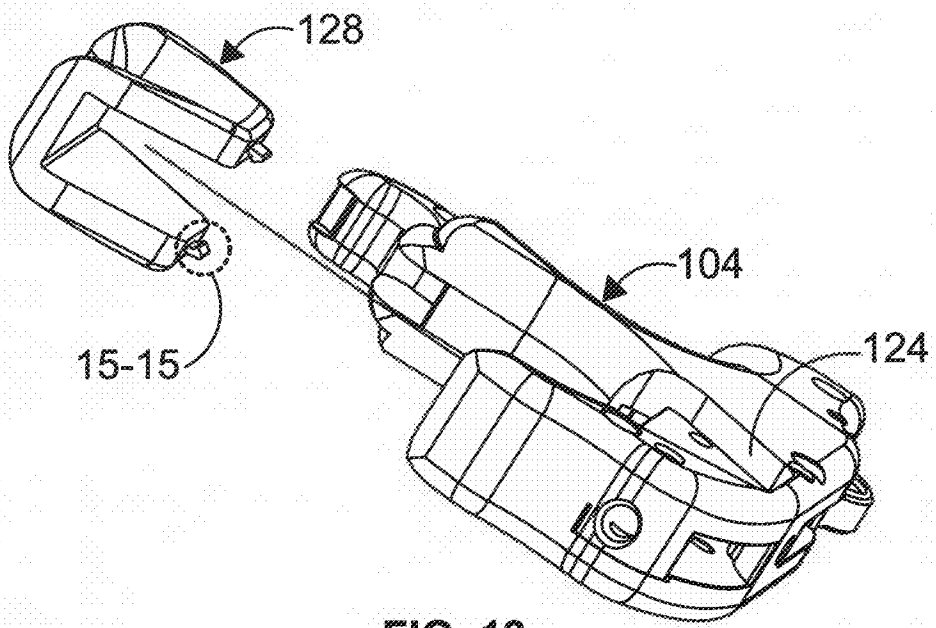
Figure 15:
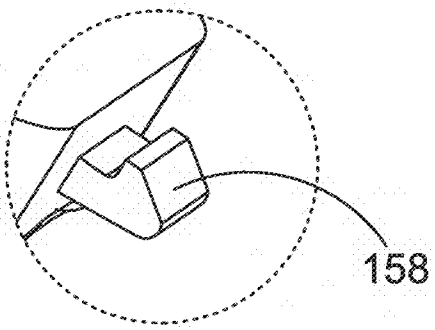
FIG. 15 is a detailed view of a portion of a finger bed taken along line 15-15 of FIG. 13.

FIGS. 6-8 show a first or index finger bed 28 and FIGS. 9-11 shown a second or middle finger bed 30. The configurations of the first and second beds are similar but the sizes preferably differ. As noted above, interchangeable finger beds are provided with different angles between the inner and outer surfaces of the finger bed. In FIG. 7, a first finger bed is shown with parallel surfaces, i.e. the angle between the surfaces is zero. In FIG. 8, a first finger bed is shown with an angle $\alpha$ of fifteen degrees between the inner and outer surfaces. Similarly, In FIG. 10, a second finger bed is shown with parallel surfaces and a zero degree angle therebetween. In FIG. 11, a second finger bed is shown with an angle $\alpha$ of fifteen degrees between the inner and outer surfaces.

It will be appreciated that different interchangeable finger beds may be provided with any angle between the inner and outer surfaces. By way of example, FIGS. 12*a*, 12*b*, 12*c*, and 12*d* are top views of an archery release according to a first embodiment of the invention where the finger beds have angles of zero, five, ten, and 15 degrees, respectively.

Figure 18:
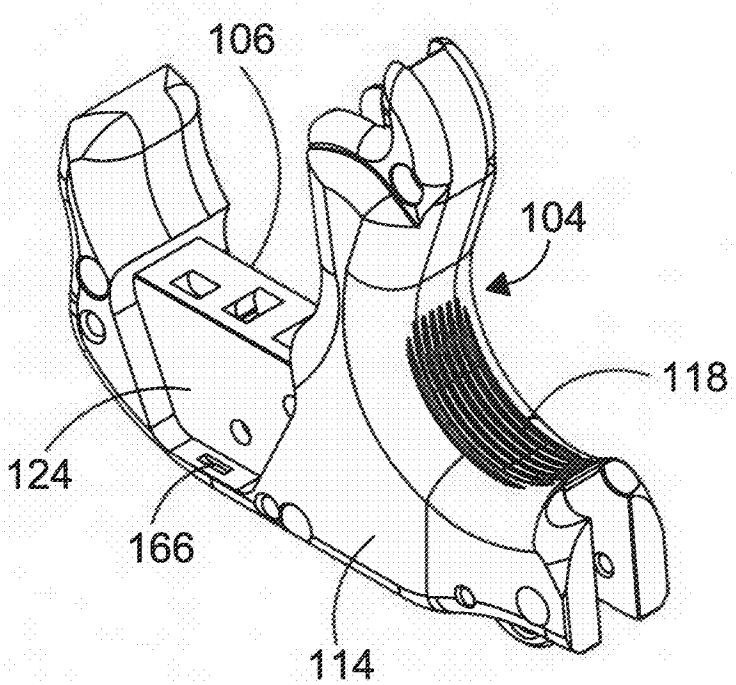
FIGS. 17 and 18 are front and rear perspective views, respectively, of the handle of the archery release of FIGS. 13 and 14.
Figure 17:
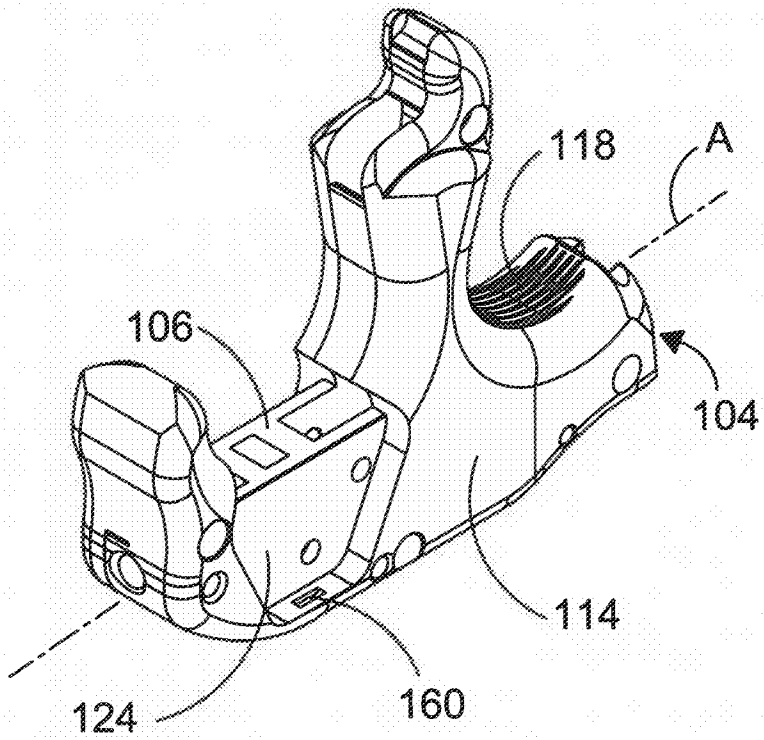
Figure 20:
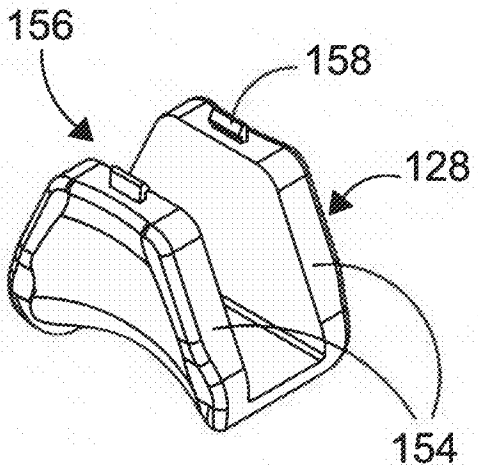
FIGS. 19, 20, and 21 are front perspective, rear perspective, and end views, respectively, of a zero degree finger bed for the archery release of FIGS. 13 and 14.
Figure 19:
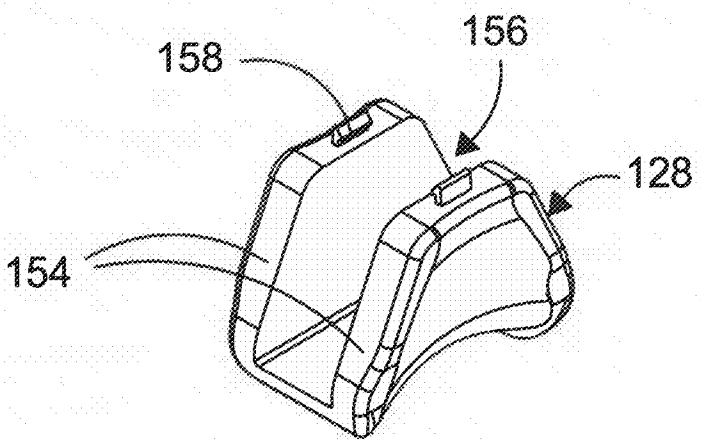

Turning now FIGS. 13-23, a second embodiment of the invention will be described. In this embodiment, the handle 104 shown more particularly in FIGS. 17 and 18 is similar to the handle of the first embodiment, but only one recess 124 is provided in each side surface 114 of the handle. The recess is preferably arranged toward the front of the handle for the index finger of the archer. A concave surface 118 is provided to support the middle finger of the archer.

A finger bed 128 is provided for connection with the handle so that the finger bed is connected with recesses in opposite side surfaces of the handle. More particularly, the finger bed includes a pair of parallel legs 154 spaced by a channel 156 as shown in FIGS. 19-22. The channel is configured to bridge to top portion 106 of the handle on opposite sides of the handle longitudinal axis. The handle top portion is shown in FIGS. 17 and 18. The legs 154 extend into the handle recesses when the finger bed is connected with the handle via a connection assembly.

The connection assembly preferably provides a snap fit connection. To this end, the end portion of each leg includes at least one projection 158 extending from an end surface. In addition, the bottom wall defining each handle recess 124 contains an opening 160 configured to receive the leg projection. As shown for example in FIGS. 15, 16, and 21, each projection 158 includes a prong-like extension which is hooked into a respective housing opening 160 for retention therein. The finger bed is preferably formed of a synthetic plastic material with a limited degree of flexure. In order to remove a finger bed from the handle, the legs are pried apart to disengage the projections 158 from the respective openings. This affords interchangeability of the finger beds.

Figure 22:
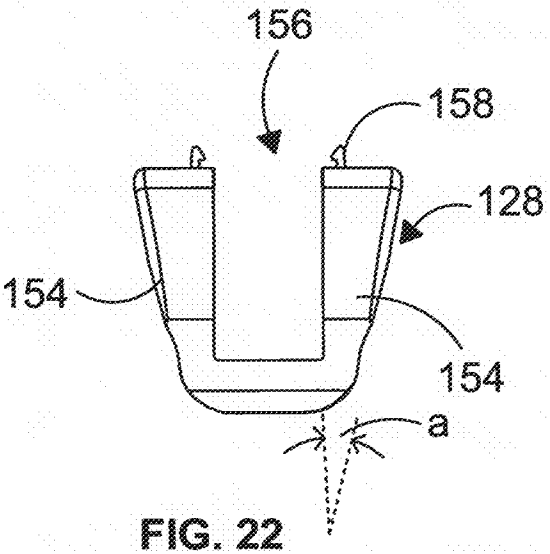
FIG. 22 is an end view of a fifteen degree finger bed for the archery release of FIGS. 13 and 14.
Figure 21:
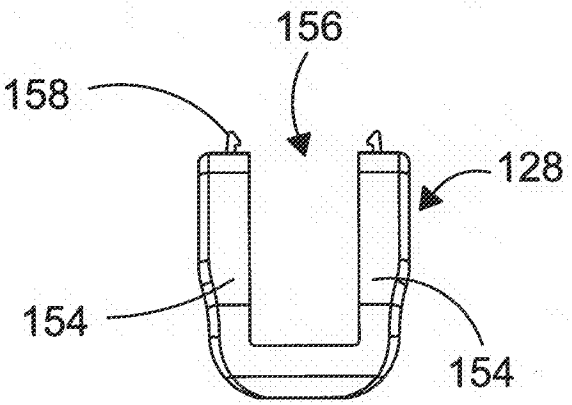
Figure 23A:
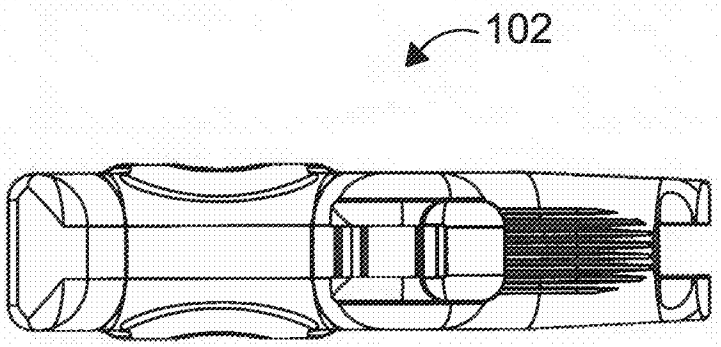
FIGS. 23*a*, 23*b*, 23*c*, and 23*d* are top views of the archery release of FIGS. 13 and 14 with zero, five, ten and fifteen degree finger beds, respectively.
Figure 23B:
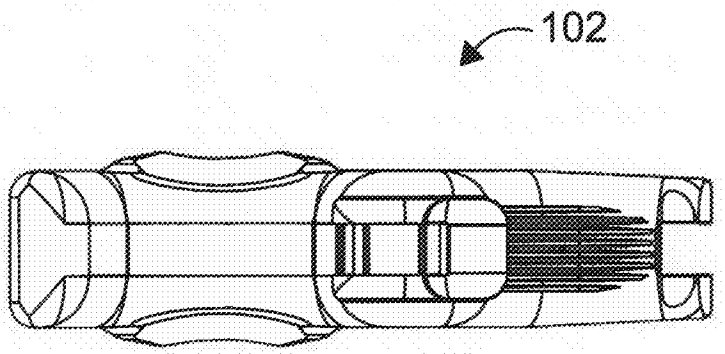
Figure 23C:
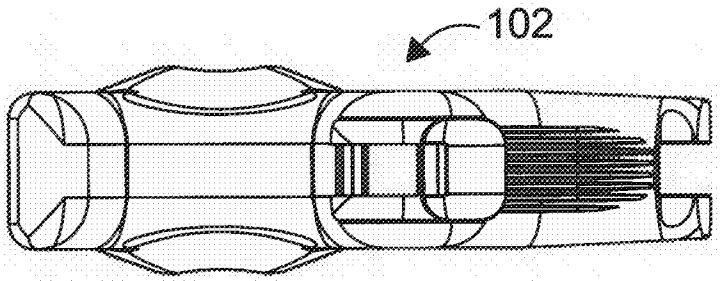
Figure 23D:
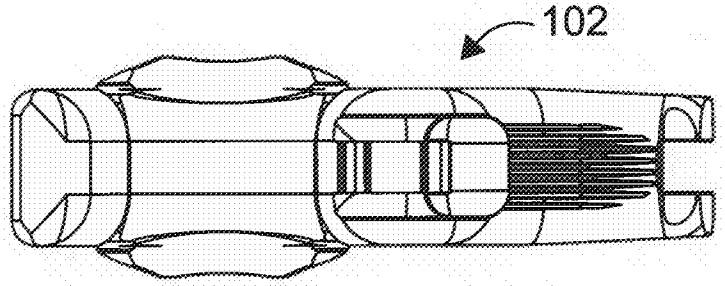

Different finger beds 128 can be provided different angles between the inner and outer surfaces of the finger bed legs. In FIG. 21, a finger bed is shown with parallel surfaces, i.e. the angle between the surfaces of each leg is zero. In FIG. 22, a finger bed is shown with an angle $\alpha$ of fifteen degrees between the inner and outer surfaces of each leg.

As in the first embodiment of FIGS. 1-12, different interchangeable finger beds may be provided with any angle between the inner and outer surfaces of the legs. By way of example, FIGS. 23*a*, 23*b*, 23*c*, and 23*d* are top views of an archery release 102 according to the second embodiment of the invention where the finger beds have angles of zero, five, ten, and 15 degrees, respectively.

In addition to providing interchangeable finger beds of different angular orientations, the archery release according to the invention can be customized by providing finger beds in different colors.

It will also be appreciated that other types of connection assemblies for the finger beds to the handle beyond a snap fit connection are possible. For example, screw and wedge connections are also suitable.

While the preferred forms and embodiments of the invention have been illustrated and described, it will become apparent to those of ordinary skill in the art that various changes and modifications may be made without deviating from the inventive concepts set forth above.

What is claimed is:

1. A handheld archery release, comprising (a) a handle having a longitudinal axis, top, bottom and side portions, said side portions each containing at least one recess; and (b) an interchangeable finger bed configured to fit within each of said recesses and having an inner surface adjacent to said handle and an outer surface arranged at an angle relative to said inner surface to support a finger of an archer.

2. A handheld archery release as defined in claim 1, and further comprising a connection assembly between said handle and said finger bed which enables said finger bed to be removably connected with said handle, whereby the archer may interchange said finger bed with another finger bed having a different angle between said inner and outer surfaces to provide a desired support position for a finger of the archer for operation of the archery release.

3. A handheld archery release as defined in claim 2, wherein said connection assembly comprises a snap fit connection.

4. A handheld archery release as defined in claim 3, wherein each handle recess is defined by front, bottom, and rear walls, said front and rear walls each containing an opening and wherein said finger bed includes front and rear end surfaces each including a projection configured to fit in a respective opening to define said snap fit connection.

5. A handheld archery release as defined in claim 4, wherein said bottom wall defining said handle recess contains an opening and said finger bed includes a bottom portion containing an opening which is aligned with said bottom wall opening when said finger bed is arranged in said handle recess, and further comprising a spring plunger which is arranged in said finger bed bottom portion opening, a portion of said plunger being removably connected with said bottom wall opening to stabilize said finger bed relative to said handle recess.

6. A handheld archery release as defined in claim 2, wherein said handle side portions each contain a pair of spaced recesses, each recess being configured to receive a finger bed via said connection assembly.

7. A handheld archery release as defined in claim 6, wherein said pair of recesses are configured to support finger beds for index and middle fingers of the archers, respectively.

8. A handheld archery release as defined in claim 7, wherein said outer surface of each finger bed has a contoured configuration.

9. A handheld archery release as defined in claim 2, wherein said finger bed has a U-shaped configuration.

10. A handheld archery release as defined in claim 9, wherein said handle side portion recesses are aligned on opposite sides of longitudinal axis of said handle.

11. A handheld archery release as defined in claim 10, wherein said finger bed contains a channel which is configured to bridge the top portion of said handle when said finger bed is arranged in said aligned recesses.

12. A handheld archery release as defined in claim 11, wherein said finger bed includes a pair of legs on opposite sides of said channel, said legs extending into said handle recesses, respectively, when said connection assembly connects said finger bed with said handle.

13. A handheld archery release as defined in claim 12, wherein said connection assembly comprises a snap fit connection.

14. A handheld archery release as defined in claim 13, wherein each handle recess is defined by front, bottom and rear walls and said bottom wall contains an opening, and wherein said finger bed legs include at least one projection extending from an end surface of each leg for a snap fit connection with said bottom wall openings, respectively.

15. A handheld archery release as defined in claim 14, wherein said finger bed outer surface has a contoured configuration on opposite sides of the release.

16. A handheld archer release as defined in claim 15, wherein said finger bed outer surface is tapered from a top portion of the release to a bottom portion thereof.

* * * * *